US007661239B2

(12) United States Patent
Price

(10) Patent No.: US 7,661,239 B2
(45) Date of Patent: Feb. 16, 2010

(54) MASONRY BRICK

(75) Inventor: Raymond R. Price, Rochester, MN (US)

(73) Assignee: Alliance Concrete Concepts Inc., Rochester, MN (US)

( * ) Notice: Subject to any disclaimer, the term of this patent is extended or adjusted under 35 U.S.C. 154(b) by 1124 days.

(21) Appl. No.: 10/688,239

(22) Filed: Oct. 17, 2003

(65) Prior Publication Data

US 2005/0081469 A1 Apr. 21, 2005

(51) Int. Cl.
*E04C 2/04* (2006.01)

(52) U.S. Cl. ..... 52/605; 405/262; 405/286; 52/169.2; 52/592.6; 52/603; 52/606

(58) Field of Classification Search ..... 52/601, 52/437, 505, 585.1, 521, 261, 270, 286, 602–607, 52/592.5, 592.6, 379, 592.2, 592.3; 446/476, 446/124, 117, 85; 405/284, 262, 286
See application file for complete search history.

(56) References Cited

U.S. PATENT DOCUMENTS 1,086,975 A * 2/1914 Aaronson ..... 428/141
3,012,377 A 12/1961 Sunukjian
3,534,518 A * 10/1970 Zagray ..... 52/258
3,818,656 A 6/1974 Vigliotti
4,121,397 A 10/1978 Marcocci et al.
D264,886 S 6/1982 Feldman
4,557,094 A 12/1985 Beliveau
4,956,958 A 9/1990 Caroti
5,586,841 A * 12/1996 Anderson et al. ..... 405/286
5,622,456 A * 4/1997 Risi et al. ..... 405/284
5,647,185 A 7/1997 Forlini
5,676,540 A 10/1997 Williams et al.
5,715,635 A * 2/1998 Sherwood ..... 52/286
5,845,444 A * 12/1998 Besche ..... 52/421
6,082,067 A * 7/2000 Bott ..... 52/592.3
6,082,933 A * 7/2000 Maguire et al. ..... 405/286
6,253,518 B1 7/2001 Azar
6,298,632 B1 * 10/2001 Sherwood ..... 52/745.1

(Continued)

*Primary Examiner*—Richard E Chilcot, Jr.
*Assistant Examiner*—Chi Q Nguyen
(74) *Attorney, Agent, or Firm*—Moore & Hansen, PLLP

(57) ABSTRACT

A dry-stackable masonry brick having a top surface, a bottom surface, a front surface, a rear surface, and opposing side surfaces. The brick is provided with a plurality of channels, which extend along the top, bottom and one side of the brick. The channels are configured and arranged so that they are able to receive a projection from one or more adjacent bricks in an interlocking relation. The brick may be positioned on either of the opposing sides in a vertical orientation, with the bottom side up, or even with the rear surface facing forwardly. The front and rear surfaces of the brick may be provided with different surface treatments to increase the number of differently configured walls that may be constructed. Moreover, the front and rear surfaces may be provided with marginal areas that are configured so that they are able to receive and retain filler material. Thus, when a plurality of bricks is assembled together into a structure and filler material is applied to the marginal areas, the structure creates the impression that it has been constructed using conventional masonry techniques and technologies. One or more bricks may be operatively connected to a suitable support or substructure by the use of one or more fastening elements, which are configured to engage a brick via one or more of its channels and/or its projection.

20 Claims, 3 Drawing Sheets

U.S. PATENT DOCUMENTS 6,679,656 B1 * 1/2004 Manthei ..... 405/284
6,715,965 B2 * 4/2004 Manthei et al. ..... 405/284
6,735,913 B2 * 5/2004 Sanders et al. ..... 52/284
6,821,058 B1 * 11/2004 Dawson ..... 405/284

* cited by examiner 128
124
126
258
272
284
122
264
270
280
260
262
286
282
288
292
268
300
258
124
126
258

258
260
302
258

304D
304A
304E
304B
304F
304C 258
280
284
286
290
258
280
264
258
258
300
280
258
288
270
260
260
258
268
266

MASONRY BRICK

FIELD OF THE INVENTION

This invention relates generally to the construction of masonry structures. More particularly, this invention relates to a brick that may be interlocked with adjacent bricks, without the need for cement or mortar.

BACKGROUND OF THE INVENTION

Masonry bricks have been used in construction for many years. They are durable, strong, able to resist large compressive forces, and relatively inexpensive to manufacture. They are widely used in many applications, but are most often used in building foundations and as load bearing walls. Typically, masonry units are joined together into a unitary structure using mortar or cement. As will be understood, this is not a simple or quick procedure, and there are many steps have to be taken before even the first brick is laid. For example, a site has to be prepared, footings that have to be planned, framed-up and poured, masonry bricks have to be delivered to the site, and mortar has to be mixed and transported to various locations at the worksite during construction. Moreover, specialized training and skills are required to assemble the bricks into a structure. Traditionally, this has been the province of bricklayers and masons. As one may well imagine, the above-mentioned steps add to the time and cost needed to assemble a structure and, unfortunately, this tends to offset the initial low cost of material. An advantage and a drawback to such a construction is that once completed, the structure is more or less permanent. Changes or alterations after-the-fact can be extremely difficult and expensive, and imperfections or mistakes are usually left as is.

There are instances, however, where it might not be possible to obtain or use mortar, or where skilled, trained workers are not available, or even where there is a limited budget. Alternatively, there might also be instances where it is not desirable or advantageous to assemble a permanent structure, or where future changes or reconfigurations are anticipated.

There is a need for a masonry brick that can be operatively connected to other masonry bricks without the use of mortar or cement. There is also a need for a masonry brick that permits a structure formed therefrom to be easily modified or disassembled without having to destroy the structure. And, there is a need for a masonry brick whose use does not require special skills or training.

BRIEF SUMMARY OF THE INVENTION

The present invention is a brick suitable for use in constructing a structure such as a wall. The brick comprises a front surface, a rear surface, opposing sides extending between the front and rear surfaces, a top surface that extends between the front, rear, and opposing sides with the top surface, and a bottom surface that extends between the front, rear, and opposed sides, with the bottom surface in opposing relation to the top surface The top surface includes a channel that extends substantially along the length of the brick. The bottom surface also includes a channel that extends substantially along the length of the brick. One of the opposing sides includes a channel that extends from the top surface to the bottom surface, and which intersects with the channels of the top and bottom surfaces. The bottom surface also includes a projection that is configured to be received within any of the top, bottom, or side channels of an adjacent brick in an interlocking relation.

As will be appreciated, a brick may be oriented in a variety of positions. For example, a brick may be oriented so that horizontally so that the front surface is exposed and the top surface is facing up. Alternatively, a brick may also be oriented horizontally so that the front surface is exposed and the bottom surface is facing up. Alternatively, a brick may be oriented horizontally so that rear surface is exposed and the top surface is facing up. On the other hand, a brick may be oriented so that the rear surface is exposed and the bottom surface is facing up. A brick may also be oriented vertically on either of its opposing sides, and so that the front and rear surfaces are exposed. It will be appreciated that the front and rear surfaces may be provided with different surface treatments, to increase the number of wall configurations available to the customer.

The channels of the bricks may also be used to receive fastening elements or ties, which are used to operatively connect one or more bricks to a suitable substructure, and which form part of a wall construction system. The fastening elements are configured so that they can engage a brick and prevent forward and rearward movement relative to a substructure.

Either one of the front or rear surfaces may be provided with marginal areas that are configured so that they are able to receive and retain filler material. This allows a wall of such bricks to create the impression that it has been constructed using conventional mortar or cement.

An object of the invention is to reduce the amount of time and skill needed to assemble masonry bricks into a structure.

Another object of the invention is to simplify construction by eliminating the need for mortar.

Another object of the invention is to provide a system by which a structure of masonry bricks may be operatively connected to a suitable support or substructure without the need for cement or mortar.

A feature of the present invention is that it allows masonry bricks to be connected to each other in different patterns and in different orientations Another feature of the invention is the provision of a fastening element, which is configured to operatively connect a masonry brick to a suitable support or substructure.

An advantage of the present invention is that a structure of masonry bricks may be assembled and disassembled with equal facility.

Additional objects, advantages and features of the invention will be set forth in part in the description which follows, and in part will become apparent to those skilled in the art upon examination of the following or may be learned by practice of the invention. The objects and advantages of the invention may be realized and attained by means of the instrumentalities and combination particularly pointed out in the appended claims.

DESCRIPTION OF THE INVENTION

For purposes of clarity, the bricks of the invention will be ascribed the arbitrary terms of top, bottom, sides, front and rear. However, it will be understood that the bricks need not be used (assembled or oriented) according to these arbitrary designations. For example, the bricks may be positioned on either of the sides in a vertical orientation. Alternatively, the bricks may be inverted so that they are upside down, or they may obverted so that they are facing backwards.

Figures 1, 2, 3, 4, 5:
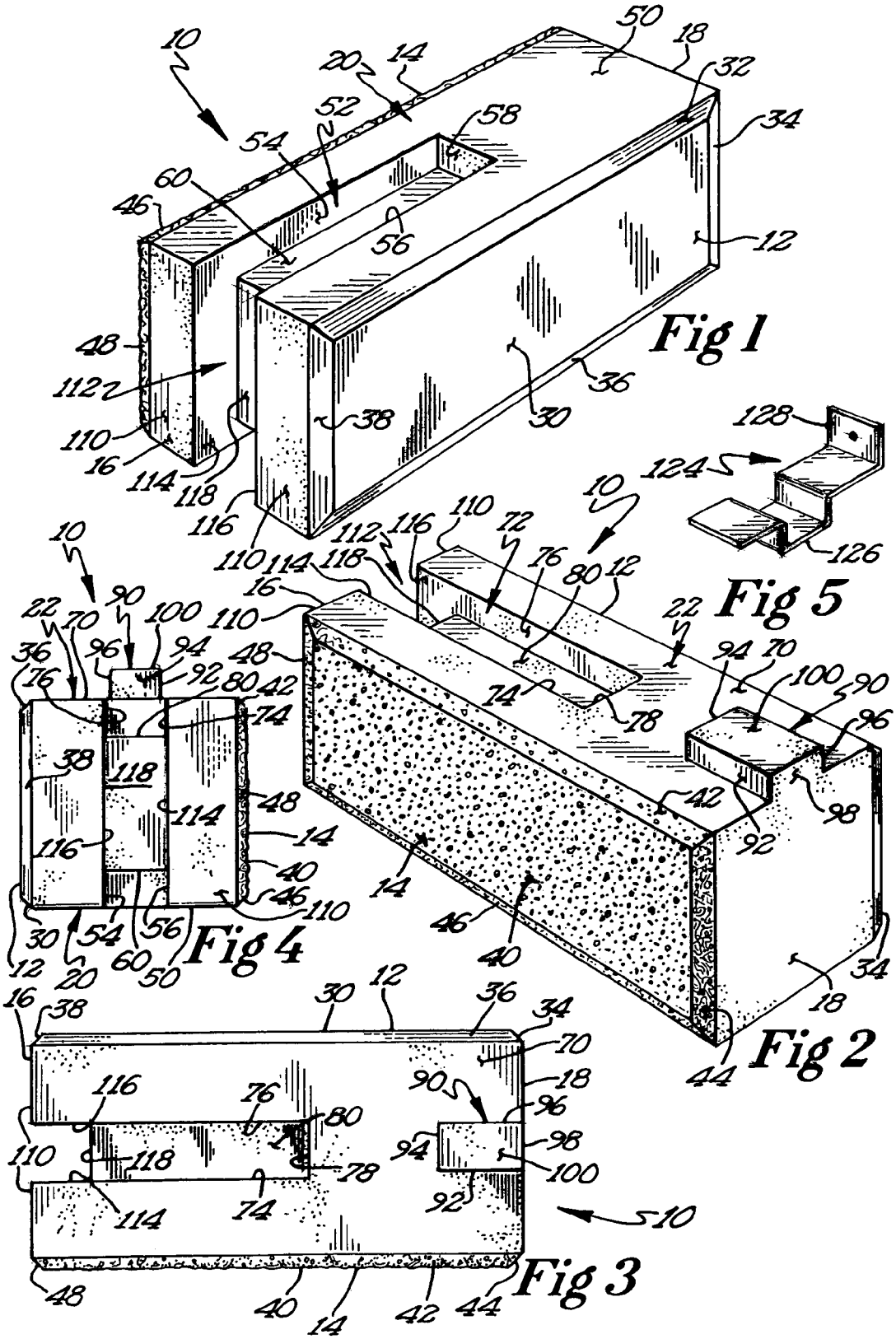
FIG. 1 is an isometric view of an embodiment of the present invention oriented in a horizontal direction and with the front, top, and one of the opposing sides visible.
FIG. 2 is an isometric view of FIG. 1, oriented in a horizontal direction and with the rear, bottom, and the other opposing sides visible.
FIG. 3 is a top plan view of FIG. 2.
FIG. 4 is an elevational view of FIG. 1.
FIG. 5 is an isometric view of a fastening element that may be used with the bricks of the present invention.

Referring now to FIG. 1, a preferred embodiment of the brick of the present invention is shown. As can be seen, the brick 10 is generally rectangular and has a front 12, a rear 14, opposing sides 16, 18, a top 20 and a bottom 22 (see also, FIG. 2). The front 12 includes a generally planar surface 30 and marginal areas 32, 34, 36, and 38. The marginal areas 32, 34, 36, and 38 are chamfered or beveled with respect to surface 30 to create a raised panel effect.

The rear 14 of the brick 10 of FIG. 1 can be seen in FIG. 2. The rear 14 also includes a generally planar surface 40 and marginal areas 42, 44, 46, and 48, which are chamfered or beveled with respect to the surface 40 to create a raised panel effect. The rear surface 14 may be provided with a different surface treatment than the front 12, if desired. Thus, for example, the rear 14 may have a roughened texture, relative to the front 12. Alternatively, the rear 14 may have the same surface treatment as the front 12, or a surface treatment that is smoother than the front 12 (not shown). It will be appreciated the provision of different surface treatments increases the number of patterns that are available to a consumer.

Referring again to FIG. 1, the top 20 of the brick includes a generally planar surface 50 and a first channel 52. As depicted, the first channel 52 extends substantially along the length of the top and is defined by a pair of sidewalls 54 and 56, an end wall 58, and a bottom wall 60.

The bottom 22 of the brick as depicted in FIG. 2 also includes a generally planar surface 70 and a second channel 72. As with the first channel, the second channel extends substantially along the length of the bottom and is also defined by a pair of sidewalls 74, and 76, an end wall 78, and a top wall 80. The bottom also includes a projection 90 that extends away from the bottom and which is defined by sidewalls, 92, 94, 96, 98, and a bottom wall 100. The projection 90 is configured to be received within channels of an adjacent brick.

The side 16 of the brick 10 as shown in FIGS. 1, 3, and 4 also includes a generally planar surface 110 and a third channel 112. The third channel 112 extends along the length of the side 16 and is defined by sidewalls 114 and 116, and end wall 118. Preferably, the third channel 112 intersects the first 52 and second 72 channels to form a generally u-shaped recess that partially girds the brick, with the unshaped recess sized to admit one or more projections from adjacent bricks.

The opposing side 18 of the brick 10, as depicted in FIG. 2, is generally planar and need not be discussed here in detail.

While it is possible to construct a freestanding brick structure, the preferred method of use is in conjunction with a suitable support or substructure. In keeping with the concept of mortarless construction, a fastening element is used. Together, the fastening element and a brick form a system by which the brick may be operatively connected to a substructure.

Figure 9:
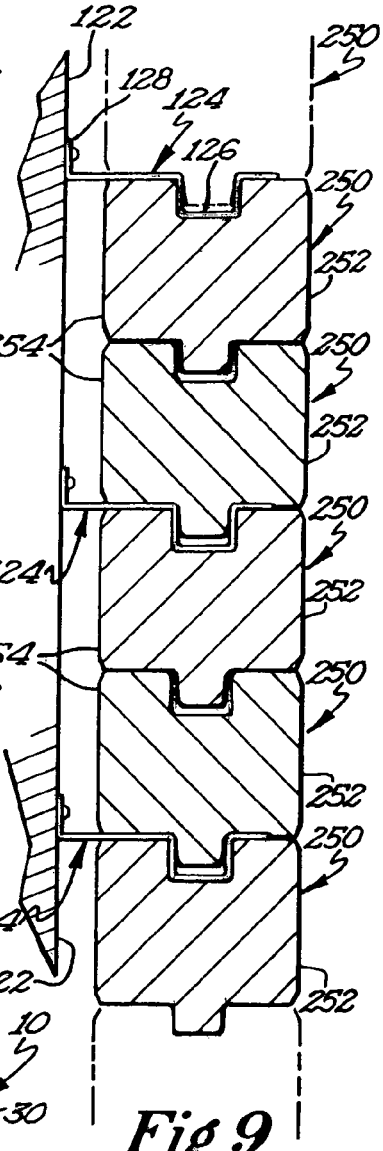
FIG. 9 is an elevational side view of a structure of bricks as it may be operatively connected to a substructure.
Figure 10:
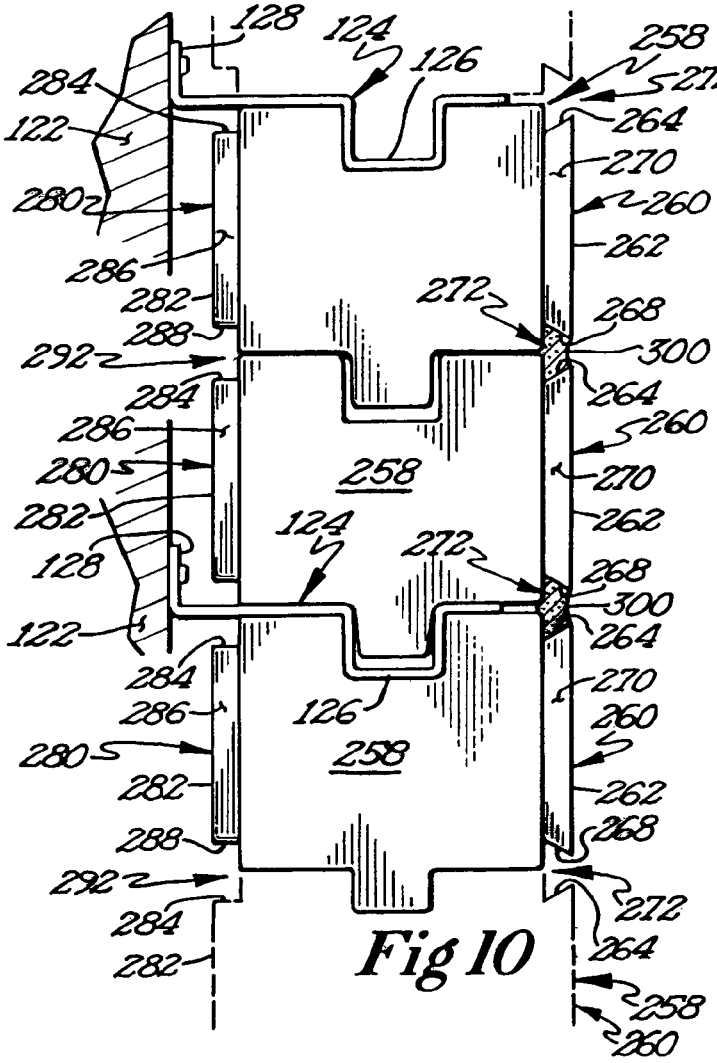
FIG. 10 is an elevational side view of another embodiment of bricks as they may be assembled into a structure that is operatively connected to a substructure. The figure also illustrates the use of filler that may be applied along the marginal areas of the bricks.

The fastening element 124, as depicted in FIG. 5, is configured to operatively connect a brick to a substructure and includes a brick engaging portion 126 and a substructure engaging portion 128. The brick engaging portion 126 is configured and arranged so that it is able to restrain motion forward and rearward motion of a brick relative to a substructure to which it is operatively connected. Preferably, this is accomplished by configuring the brick engaging portion 126 so that it engages the sidewalls 54 and 56, 74 and 76, 114 and 116, respectively, of any one of the first, second, or third channels. It will be appreciated that restraint may also be accomplished by positioning the brick engaging portion 126 so that it engages the sidewalls 92 and 96 of a projection 90. Preferably, though, the brick engaging portion 126 will be positioned between a channel and a projection, as depicted in FIGS. 9 and 10. In that regard, when the brick engaging portion of a fastening element is captured between a projection and a channel as depicted in FIGS. 9 and 10, it will be understood that it is not necessary for the brick engaging portion to contact both sidewalls of the channel. Rather, the brick engaging portion may be shortened so that it contacts only one sidewall (not shown).

Preferably, the substructure engaging portion 128 of the fastening element 124 is provided with an aperture (see, FIG. 5) through which an appropriately sized nail or screw may be inserted and driven into a substructure (see, FIGS. 9 and 10). While the preferred method of attaching the fastening element to a substructure are nails and screws, other forms of attachment are possible without departing from the spirit and scope of the invention.

Figure 6:
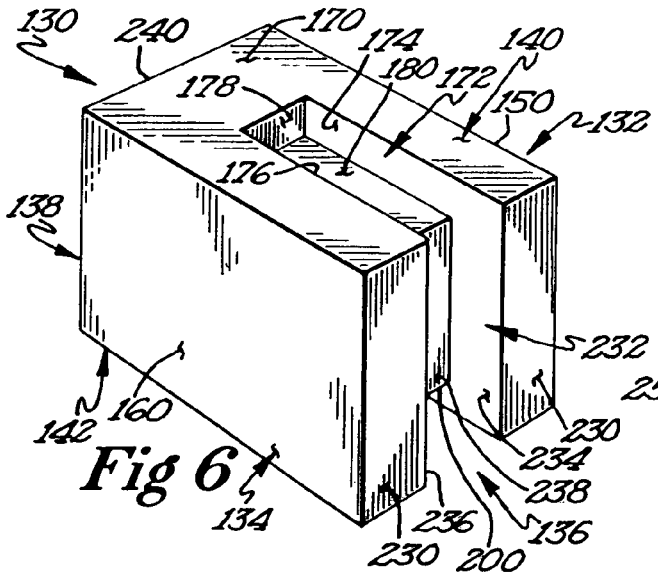
FIG. 6 is an isometric view of another embodiment of the present invention oriented in a horizontal direction and with the front, top, and one of the opposing sides visible.
Figure 7:
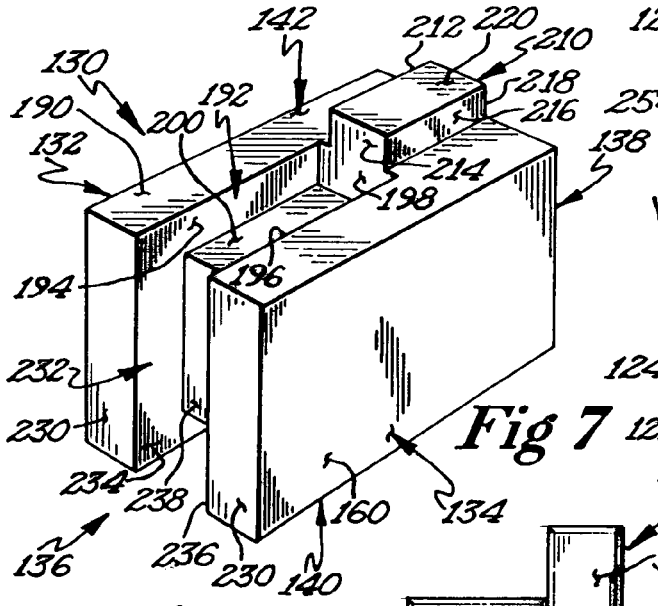
FIG. 7 is an isometric view of FIG. 6, oriented in a horizontal direction and with the rear, bottom and the other opposing sides visible.

Referring now to FIGS. 6 and 7, another preferred embodiment of the brick of the present invention is shown. This embodiment is a shortened version of the block of FIGS. 1-4. Here, the brick 130 is generally rectangular and has a front 132, a rear 134, opposing sides 136, 138, a top 140 and a bottom 142. In this embodiment, the front 132 and rear 134 have generally planar surfaces 150 and 160, respectively, which are depicted as having similar surface treatments. However, it is understood that the front and rear surfaces 150 and 160 may be provided with different surfaces if desired.

The top 140, as depicted in FIG. 6 includes a generally planar surface 170 and a first channel 52. As depicted, the first channel 172 extends substantially along the length of the top and is defined by a pair of sidewalls 174 and 176, an end wall 178, and a bottom wall 180. The bottom 142, as depicted in FIG. 7 includes a generally planar surface 190 and a second channel 192. As with the first channel 172, a second channel 192 extends substantially along the length of the bottom 142 and is defined by a pair of sidewalls 194, and 196, an end wall 198, and a top wall 200. The bottom 142 also includes a projection 210 that extends away from the bottom and which is defined by sidewalls, 212, 214, 216, 218, and a bottom wall 220. The projection 210 is configured to be received within channels of an adjacent brick.

The side 136 of the brick 130 as shown in FIGS. 6 and 7 also includes a generally planar surface 230 and a third channel 232. The third channel 232 extends along the length of the side 230 and is defined by sidewalls 234 and 236, and end wall 238. Preferably, the third channel 232 intersects the first 172 and second 192 channels to form a generally u-shaped recess that partially girds the brick, with the u-shaped recess sized to admit one or more projections from adjacent bricks.

As will be understood, the brick 130 of FIGS. 6 and 7 may be used in conjunction with the fastening element 124 as shown in FIG. 5, as part of a wall construction system.

Figure 8:
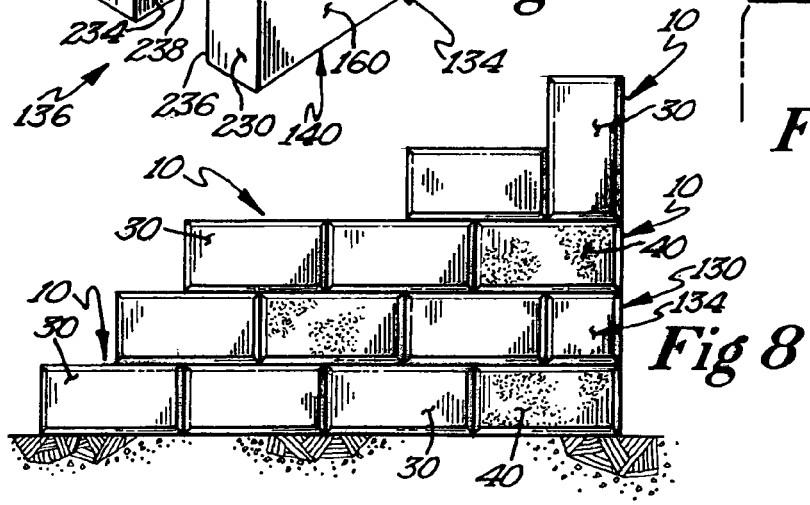
FIG. 8 is a front plan view of a structure formed with bricks of the present invention.

A wall structure that may be constructed using bricks of the present invention is depicted in FIG. 8. Note that some of the bricks 10 have their front surfaces 30 facing forward, while other bricks 10 have their rear surfaces 40 facing forward. Note also that the bricks may be oriented in a vertical direction.

FIG. 9 exemplifies how a wall construction may be operatively attached to a suitable support or substructure 122. Here, brick 250 having front 252 and rear 254 is stacked upon similar bricks 250 in courses so that the fronts 252 all face a viewer. Note that it is not necessary for the fastening elements 124 to be used between every course of bricks. Rather, fastening elements 124 may be positioned between bricks in every other course of bricks. However, it will be appreciated that the number of fastening elements used per brick can vary.

Figure 11:
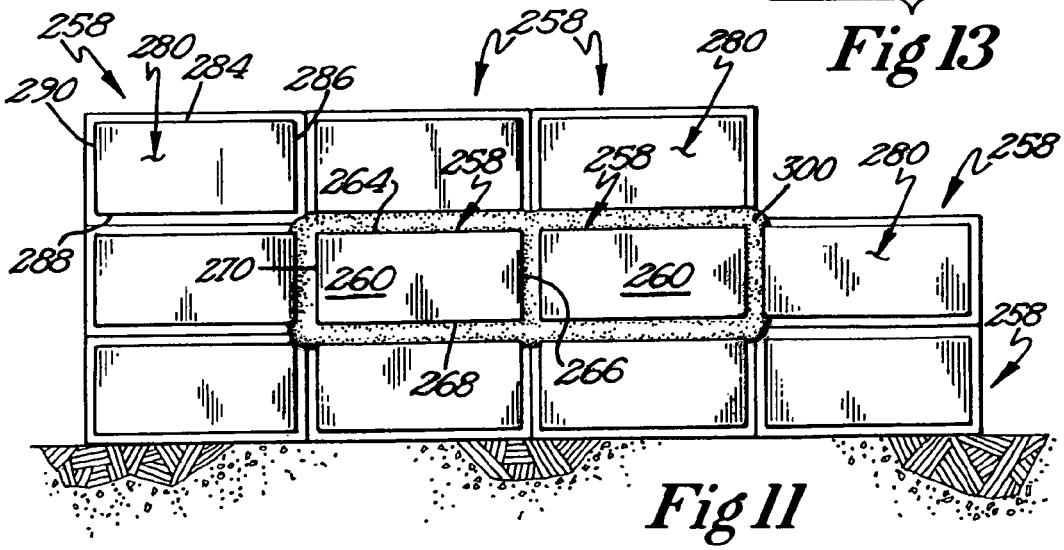
FIG. 11 is a front plan view of a structure formed with the bricks of FIG. 10 and illustrating filler that has been applied to marginal areas of some of the bricks.

A wall construction system featuring another embodiment of brick is shown in FIGS. 10 and 11. The brick 258 has a front, rear, opposing sides, a top, and a bottom, and channels and a projection similar to the previously described embodiments of FIGS. 1 and 2, which have been previously discussed. However, has a front 260 and rear 280 differ than earlier described embodiments. Similar to the earlier described embodiments, the front and rear of this embodiment include generally planar surfaces 260 and 280, respectively and marginal areas. However, in this embodiment, the marginal areas 264, 266, 268 and 270, of the front 260 and the marginal areas 284, 286, 288, and 290 of the rear 280 are not angled towards their respective perimeters. Rather, the marginal areas are angled so that they undercut or are generally perpendicular to the respective front and rear surfaces 262 and 282.

As shown in FIG. 10, when bricks 258 are assembled into a wall structure, the marginal areas of bricks in adjacent courses form front and rear pockets 272 and 292. Filler material 300 may then be placed into the pockets, if desired, so that a wall creates the impression that it has been constructed using conventional technologies and techniques. Preferably, the filler material 300 is applied after a wall has been assembled. FIG. 11 depicts a wall that has been partially finished with filler material. As will be appreciated, the filler can be any material that may give the impression that the structure has been constructed using mortar or cement. For instance, the filler could actually be cement or mortar. Alternatively, the filler could be grout, putty, silicone sealant, expandable foam, or other like material that may be applied in an uncured state and allowed to cure in situ.

Figure 12:
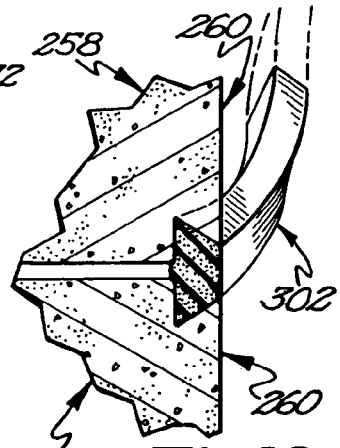
FIG. 12 is a partial, cross-sectional, side view of two adjacent bricks with marginal areas between which filler in the form of a strip has been partially applied; and, FIG. 13 depicts cross-sectional views of filler strips having different viewable surfaces.

The filler could also be strips of solid or elastic material that is configured to be inserted into the pockets, as depicted in FIG. 12. As shown, a filler 302 is depicted as being preformed to approximate the shape of pocket defined by the marginal areas of adjacent bricks. It will be understood, however, that the filler 302 need not mirror the shape of a pocket in order to practice the invention.

Figure 13:
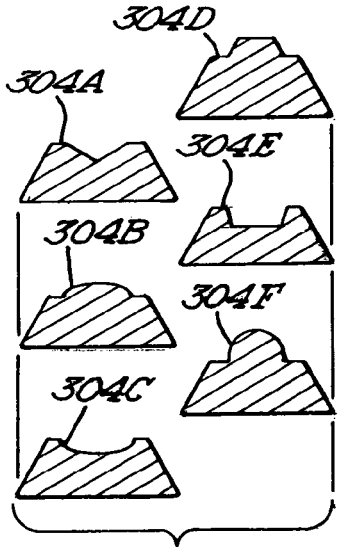

As will be appreciated, the viewable surface of the filler 302 need not be restricted to any particular shape or pattern. For example, the viewable surface of the filler 302 may be angled, convex, or concave as depicted in 304*a*, 304*b*, and 304*c* of FIG. 13. Alternatively, the viewable surface may be tiered, or may have a channel or a bead as depicted at 304*d*, 304*e*, and 304*f*, respectively, of FIG. 13. It will also be appreciated that the filler 302 is also not restricted to any particular composition. For example, the filler may be rubber, foam rubber, plastic, wood, metal, or like materials. In addition, it is envisioned that in some situations, it may be desirable to include adhesive material as part of the wall system, as a primary or secondary means of installing filler to a structure.

A benefit from using the above-mentioned filler in conjunction with bricks in a wall system is that moisture is prevented from migrating from the front, exposed surface of the wall to the rear surface. Thus, water damage is greatly reduced. In addition, heat loss is reduced by preventing air from infiltrating between the bricks and setting up convection currents between the wall and a substructure.

The present invention having thus been described, other modifications, alterations or substitutions may present themselves to those skilled in the art, all of which are within the spirit and scope of the present invention. It is therefore intended that the present invention be limited in scope only by the claims attached below:

What is claimed is:

1. A brick suitable for use in constructing a mortarless wall, the brick comprising:
- a front surface;
- a rear surface;
- opposing sides having surfaces extending between the front and rear surfaces;
- a top surface extending between the front, rear, and opposing sides, the top surface comprising a first channel; and,
- a bottom surface extending between the front, rear, and opposed side surfaces, the bottom surface in opposing relation to the top surface, the bottom surface comprising a second channel and a projection, with the projection located between the front and rear surfaces, and with the projection configured and arranged to extend from the bottom surface and be received within a channel of an adjacent brick in an interlocking relation; wherein one of the opposing side surfaces comprises a third channel that extends substantially along said one opposing side surface and wherein the third channel intersects the first channel.

2. The brick of claim 1, wherein the first channel extends substantially along the top surface.

3. The brick of claim 1, wherein the second channel extends substantially along the bottom surface.

4. The brick of claim 1, wherein the first and second channels are in substantial vertical alignment with each other.

5. The brick of claim 1, wherein the third channel intersects the second channel.

6. The brick of claim 1, wherein the projection is in substantial linear alignment with the second channel.

7. The brick of claim 1, wherein the projection is in substantial coplanar alignment with the first channel.

8. The brick of claim 1, wherein the front and rear surfaces have different textures.

9. The brick of claim 1, wherein the front surface has a roughened texture.

10. The brick of claim 9, wherein the marginal area is configured to receive and retain filler.

11. The brick of claim 1, wherein the front surface is generally planar and comprises at least one marginal area, wherein the marginal area is angled with respect to the front surface.

12. The brick of claim 1, wherein the rear surface is generally planar and comprises at least one marginal area, wherein the marginal area is angled with respect to the front surface.

13. The brick of claim 12, wherein the marginal area is configured to receive and retain filler.

14. The brick of claim 1, wherein the top surface is substantially contiguous.

15. The brick of claim 1, wherein the bottom surface is substantially contiguous.

16. A brick suitable for use in constructing a mortarless wall, the brick comprising:

a front surface;

a rear surface;

opposing sides having surfaces extending between the front and rear surfaces;

a top surface extending between the front, rear, and opposing sides, the top surface comprising a first channel; and, a bottom surface extending between the front, rear, and opposed side surfaces, the bottom surface in opposing relation to the top surface, the bottom surface comprising a second channel and a projection, with the projection located between the front and rear surfaces, and with the projection configured and arranged to extend from the bottom surface and be received within a channel of an adjacent brick in an interlocking relation; wherein one of the opposing side surfaces comprises a third channel that extends substantially along the one opposing side surface and wherein the third channel intersects the second channel.

17. The brick of claim 16, wherein the first channel and the second channel are substantially parallel with respect to each other.

18. The brick of claim 16, wherein the first channel and the second channel are substantially perpendicular with respect to each other.

19. The brick of claim 16, wherein the projection is substantially rectilinear.

20. The brick of claim 16, wherein the third channel intersects the first channel.

* * * * *